US009423810B2

(12) United States Patent
Chen et al.

(10) Patent No.: US 9,423,810 B2
(45) Date of Patent: Aug. 23, 2016

(54) VOLTAGE REGULATOR AND CONTROL METHOD THEREOF

(71) Applicant: INDUSTRIAL TECHNOLOGY RESEARCH INSTITUTE, Hsinchu (TW)

(72) Inventors: Long-Der Chen, Zhubei (TW); Dau-Chen Huang, Zhubei (TW); Yu-Chen Lin, Zhubei (TW); Ke-Horng Chen, Hsinchu (TW); Shen-Yu Peng, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 74 days.

(21) Appl. No.: 14/231,084

(22) Filed: Mar. 31, 2014

(65) Prior Publication Data

US 2015/0102792 A1 Apr. 16, 2015

Related U.S. Application Data

(60) Provisional application No. 61/891,722, filed on Oct. 16, 2013.

(30) Foreign Application Priority Data

Dec. 20, 2013 (TW) ..... 102147464 A

(51) Int. Cl.
*G05F 1/00* (2006.01)
*G05F 1/59* (2006.01)
*G05F 1/563* (2006.01)

(52) U.S. Cl.
CPC . *G05F 1/59* (2013.01); *G05F 1/563* (2013.01)

(58) Field of Classification Search
CPC ..... G05F 1/461; G05F 1/59; H02M 3/158
USPC ..... 323/241, 246, 267–269, 271, 272, 323/274–276, 283–285
See application file for complete search history.

(56) References Cited

U.S. PATENT DOCUMENTS 6,269,012 B1 7/2001 Kusakabe et al.
7,737,673 B2 6/2010 Xi et al.

(Continued)

FOREIGN PATENT DOCUMENTS

CN 102104336 A 6/2011
CN 202632143 12/2012

(Continued)

OTHER PUBLICATIONS

Taiwan Patent Office, Office Action, May 18, 2015, Taiwan.

(Continued)

*Primary Examiner* — Adolf Berhane
*Assistant Examiner* — Gary Nash
(74) *Attorney, Agent, or Firm* — Locke Lord LLP; Tim Tingkang Xia, Esq.

(57) ABSTRACT

A voltage regulator and a control method thereof are provided to dynamically adjust an output voltage. The voltage regulator comprises a plurality of switching transistors and a control circuit. The first end of each switching transistor receives a driving voltage, and the second end of each switching transistor is electrically connected to the end which outputs the output voltage. The input end and the feedback end of the control circuit respectively receive a reference voltage and the output voltage. A plurality of output ends of the control circuit are electrically connected to the control ends of the switching transistors respectively. Switching transistors adjust the output voltage. The control circuit compares the output voltage with the reference voltage, and selectively turns the switching transistors on or off according to the comparison between the output voltage and the reference voltage, to control the output voltage to approach the reference voltage.

15 Claims, 7 Drawing Sheets

(56) References Cited

U.S. PATENT DOCUMENTS

| | | | | |
|---|---|---|---|---|
| 7,836,322 | B2 | 11/2010 | Chapuis et al. | |
| 7,872,454 | B2 | 1/2011 | Sutardja | |
| 8,134,354 | B2 | 3/2012 | Tang et al. | |
| 2004/0119453 | A1* | 6/2004 | Clark | G05F 1/56 323/283 |
| 2005/0040800 | A1 | 2/2005 | Sutardja | |
| 2008/0116863 | A1 | 5/2008 | Luo | |
| 2009/0121694 | A1 | 5/2009 | Wyatt | |
| 2011/0316518 | A1 | 12/2011 | Feng et al. | |
| 2012/0062192 | A1* | 3/2012 | Okuma | G05F 1/56 323/272 |
| 2013/0088278 | A1* | 4/2013 | Spalding, Jr. | H03K 17/0822 327/401 |
| 2013/0169247 | A1* | 7/2013 | Onouchi | G05F 1/59 323/269 |

FOREIGN PATENT DOCUMENTS

| | | | |
|---|---|---|---|
| CN | 103592987 | A | 2/2014 |
| EP | 1524572 | B1 | 12/2011 |
| JP | 2003009515 | A | 1/2003 |
| TW | 201023682 | A | 6/2010 |
| TW | 201315122 | A | 4/2013 |
| TW | M450141 | U | 4/2013 |
| TW | I399639 | B | 6/2013 |
| WO | 2012080788 | A1 | 6/2012 |

OTHER PUBLICATIONS

Yasuyuki Okuma et al., 0.5-V input digital LDO with 98.7% current efficiency and 2.7- μA quiescent current in 65nm CMOS, IEEE, 2010.

Koji Hirairi et al, 13% Power reduction in 16b integer unit in 40nm CMOS by adaptive power supply voltage control with parity-based error prediction and detection (PEPD) and fully integrated digital LDO, IEEE International Solid-State Circuits Conference, 2012. Session 28, Adaptive & Low-Power Circuits.

Yongtae Kim et al., A 0.38 V near/sub-VT digitally controlled low-dropout regulator with enhanced power supply noise rejection in 90 nm CMOS process, IET Circuits Devices Syst., The Institution of Engineering and Technology, 2013, p. 31-41, vol. 7, Iss. 1.

Masafumi Onouchi et al., A 1.39-V input fast-transient-response digital LDO composed of low-voltage MOS transistors in 40-nm CMOS process, IEEE Asian Solid-State Circuits Conference, 2011, Jeju, Korea.

Kazuo Otsuga et al., An on-chip 250 mA 40 nm CMOS digital LDO using dynamic sampling clock frequency scaling with offset-free TDC-based voltage sensor, IEEE, 2012.

Yen-Chia Chu et al., Digitally Controlled Low-Dropout Regulator with Fast-Transient and Autotuning Algorithms, IEEE Transactions on Power Electronics, 2013, vol. 28, No. 9.

State Intellectual Property Office of the P. R. C, "Office Action", Oct. 8, 2015, China.

* cited by examiner

VOLTAGE REGULATOR AND CONTROL METHOD THEREOF

CROSS-REFERENCE TO RELATED APPLICATIONS

This application claims the priority benefits of U.S. provisional application Ser. No. 61/891,722, filed on Oct. 16, 2013 and Taiwan application serial no. 102147464, filed on Dec. 20, 2013. The entirety of each of the above-mentioned patent applications is hereby incorporated by reference herein and made a part of this specification.

TECHNICAL FIELD

This disclosure relates to a voltage regulator and a control method thereof.

BACKGROUND

The power management system for the conventional processor (such as the processors inside smart phones or cars) usually has a set of low dropout (LDO) regulators to dynamically adjust voltages. Generally, the LDO regulator is primarily embodied by the analog control technology or the sync digital control technology.

If the LDO regulator is embodied by the analog control technology, the reaction speed of the LDO regulator actively adjusting the voltage is limited by the bandwidth related with the analog control circuit, so the speed of adjusting the voltage cannot be increased effectively. Furthermore, when the LDP regulator operates in the static state, since the LDO regulator still needs to provide the bias current to maintain its operation, the static work current for the analog control circuit cannot be decreased during the static state.

If the LDO regulator is embodied by the sync digital control technology, the reaction speed of the LDO regulator dynamically adjusting the voltage is limited by the clock rate of the clock frequency signal for the digital control circuit. In order to increase the reaction speed of the LDO regulator actively adjusting the voltage, the clock rate of the clock frequency signal has to be increased. However, increasing the clock rate of the clock frequency signal will increase the current waste of the digital control circuit and also cause the occurrence of inrush current.

SUMMARY

According to one or more embodiments, the disclosure provides a voltage regulator adapted to dynamically adjust an output voltage from a first output end of the voltage regulator. In one embodiment, the voltage regulator comprises a plurality of switching transistors and a control circuit. Each switching transistor has a first end for receiving a driving voltage, a second end electrically connected with the first output end, and a control end. The switching transistors adjust the output voltage. The control circuit comprises an input end for receiving a reference voltage, a feedback end for receiving the output voltage, and a plurality of second output ends electrically connected with the control ends of the switching transistors respectively. The control circuit compares the output voltage with the reference voltage, and selectively turns on or off the switching transistors according to the comparison between the output voltage and the reference voltage whereby the output voltage approaches the reference voltage.

According to one or more embodiments, the disclosure also provides a control method of a voltage regulator, which is adapted to dynamically adjust an output voltage outputted by the voltage regulator which comprises a plurality of switching transistors and a control circuit, and each switching transistor has a first end for receiving a driving voltage, a second end electrically connected with an end outputting the output voltage, and a control end electrically connected with the control circuit. In one embodiment, the control method comprises the following steps. First, an output voltage is fed back to a control circuit. Secondly, the output voltage is compared with a reference voltage. Lastly, the switch transistors are selectively turned on or off according to the comparison between the output voltage and the reference voltage, whereby the output voltage approaches the reference voltage.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

Figure 1:
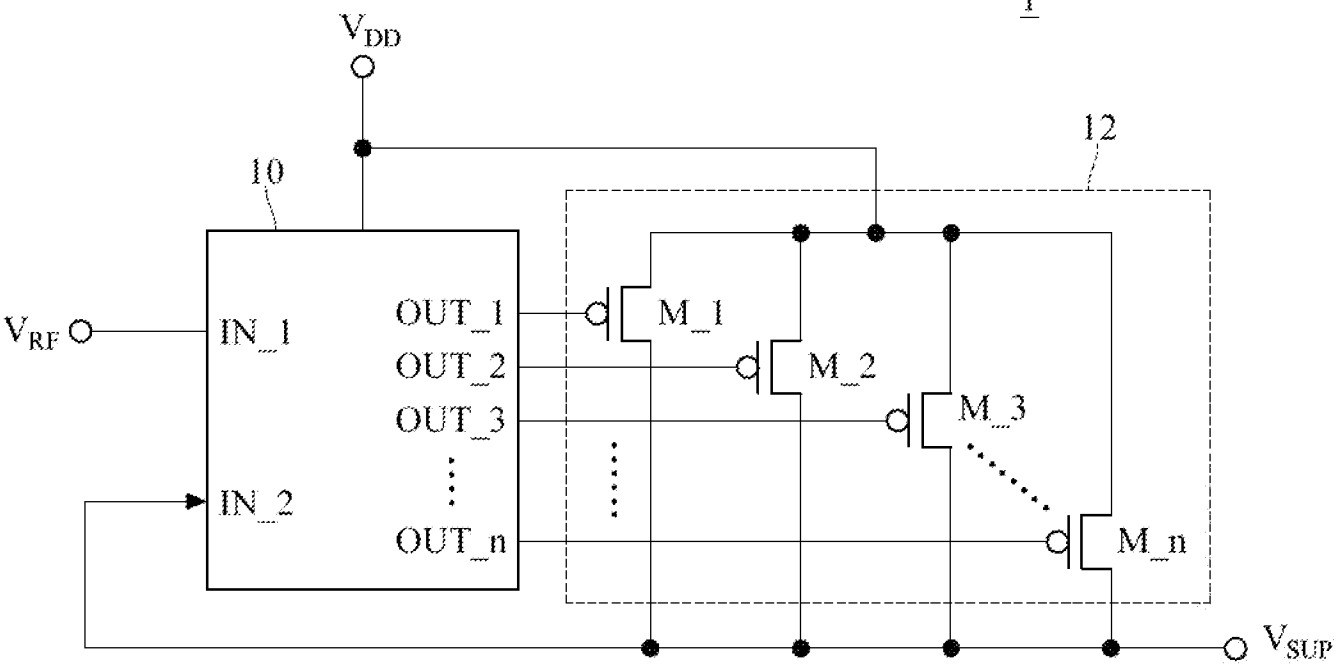
FIG. 1 is a block diagram of a voltage regulator in an embodiment in the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The disclosure provides a voltage regulator according to one or more embodiments. Referring to FIG. 1, a block diagram of a voltage regulator 1 in one embodiment is described. The voltage regulator 1 is adapted to dynamically adjust an output voltage $V_{SUP}$ from the output end (or called the first output end) of the voltage regulator 1. The voltage regulator 1 comprises a control circuit 10 and a transistor array 12.

The transistor array 12 comprises a plurality of switching transistors M_1 to M_n, wherein n is a positive integer larger or equal to 1. Each of the switching transistors M_1 to M_n has a first end for receiving a driving voltage $V_{DD}$, a second end electrically connected with the output end (i.e. the nodes supply the output voltage $V_{SUP}$) of the voltage regulator 1, and a control end. In one embodiment, each of the switching transistors M_1 to M_n may be a metal oxide semiconductor field effect transistor (MOSFET). In this case, the source of the MOSFET may be the first end of the switching transistor, the drain of the MOSFET may be the second end of the switching transistor, and the gate of the MOSFET may be the control end of the switching transistor.

The control circuit 10 comprises an input end IN_1, a feedback end IN_2, and a plurality of output ends (or called second output ends) OUT_1 to OUT_n. The input end IN_1 receives a reference voltage $V_{RF}$. The feedback end IN_2 receives the output voltage $V_{SUP}$ which is fed back from the output end of the voltage regulator 1. The output ends OUT_1 to OUT_n are electrically connected with the control ends of the switching transistors M_1 to M_n respectively so that the switching transistors M_1 to M_n are able to be controlled by the control circuit 10.

The control circuit 10 is configured to compare the output voltage $V_{SUP}$ with the reference voltage $V_{RF}$ to selectively turn on or off the switching transistors M_1 to M_n so that the output voltage $V_{SUP}$ approaches the reference voltage $V_{RF}$. Specifically, when the control circuit 10 determines that the output voltage $V_{SUP}$ is smaller than the reference voltage $V_{RF}$, the control circuit 10 turns on one or more of the switching transistors M_1 to M_n. Herein, since the equivalent resistance value of the transistor array 12 increases, the driving current flowing through the transistor array 12 increases, and then the output voltage $V_{SUP}$ increases until the output voltage $V_{SUP}$ is larger or equal to the reference voltage $V_{RF}$. On the other hand, when the control circuit 10 determines that the output voltage $V_{SUP}$ is larger than the reference voltage $V_{RF}$, the control circuit 10 turns off one or more of the switching transistors M_1 to M_n. Herein, since the equivalent resistance value of the transistor array 12 decreases, the driving current flowing through the transistor array 12 decreases, and then the output voltage $V_{SUP}$ decreases until the output voltage $V_{SUP}$ is smaller or equal to the reference voltage $V_{RF}$. Whenever the output voltage $V_{SUP}$ is smaller than the reference voltage $V_{RF}$, the control circuit 10 repeats the aforementioned operation. In other words, the switching transistors M_1 to M_n are configured to adjust the output voltage $V_{SUP}$.

Figure 2:
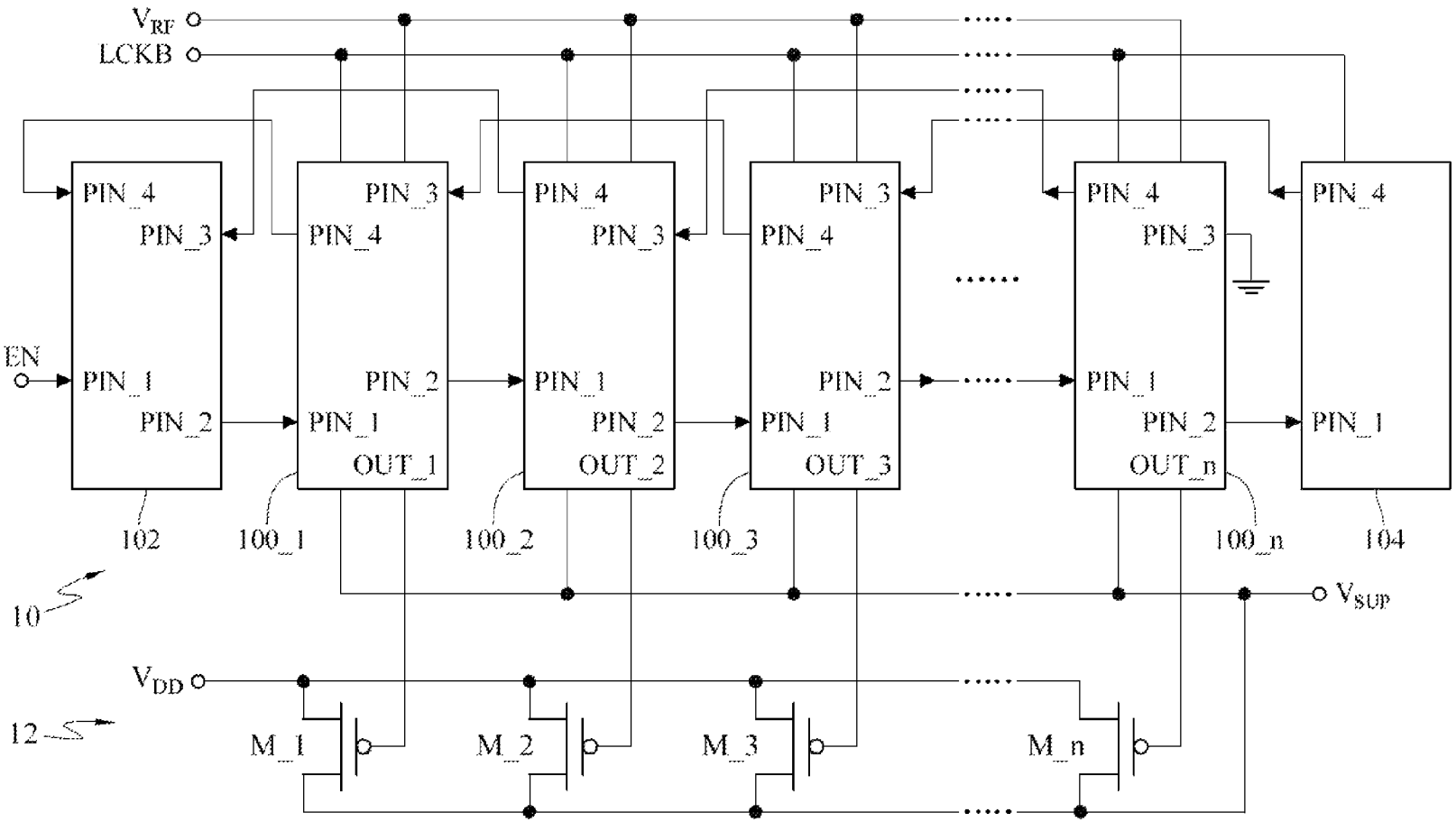
FIG. 2 is a block diagram of the control circuit in FIG. 1.

To more clearly illustrate the operation of the control circuit 10, please refer to FIG. 2 which is a block diagram of the control circuit in FIG. 1. The control circuit 10 primarily comprises a plurality of driving modules 100_1 to **100_*n*, a first reflecting module 102, and a second reflecting module 104. The driving modules 100_1 to 100_*n* are electrically connected with each other. Each of the driving modules 100_1 to 100_*n* receives the reference voltage $V_{RF}$ and the output voltage $V_{SUP}$. The output ends OUT_1 to OUT_n of the driving modules 100_1 to 100_*n* are electrically connected with the control ends of the switching transistors M_1 to M_n in the transistor array 12** respectively.

Each driving module comprises a first input pin PIN_1, a first output pin PIN_2, a second input pin PIN_3, and a second output pin PIN_4. The first reflecting module 102 comprises a first input pin PIN_1, a first output pin PIN_2, a second input pin PIN_3, and a third input pin PIN_4. The second reflecting module 104 comprises an input pin PIN_1 and an output pin PIN_4. The first output pin PIN_2 of the first reflecting module 102 is connected with the first input pin PIN_1 of the driving module 100_1. The first output pin PIN_2 of the driving module **100_*n* is connected with the input pin PIN_1 of the second reflecting module 104. The first output pin PIN_2 of the driving module 100_1 is connected with the first input pin PIN_1 of the next stage driving module (i.e. the driving module 100_2. Similarly, the first output pin PIN_2 of the driving module 100_2 is connected with the first input pin PIN_1 of the driving module 100_3. The connection of the first output pins PIN_2 of the rest of the driving modules 100_1 to 100_*n* can be deduced by analogy. The second input pin PIN_3 and the third input pin PIN_4 of the first reflecting module 102 are connected with the second output pin PIN_4 of the driving module 100_2 and the second output pin PIN_4 of the driving module 100_1 respectively. The output pin PIN_4 of the second reflecting module 104 is connected with the second input pin PIN_3 of the driving module 100_*n*−1. The second output pin PIN_4 of the driving module 100_3 is connected with the second input pin PIN_3 of the driving module (i.e. the driving module 100_1) before the previous stage driving module (i.e. the driving module 100_2) of the driving module 100_3. Similarly, the second output pin PIN_4 of the driving module 100_4 is connected with the second input pin PIN_3 of the driving module 100_2). The connection of the second output pins PIN_4 of the rest of the driving module 100_1 to 100_*n* can be deduced by analogy. The second input pin PIN_3 of the driving module 100_*n*** is grounded.

When the first input pin PIN_1 of the Ith stage driving module **100_*i* in the driving modules 100_1 to 100_*n* receives a triggering signal, the Ith stage driving module 100_*i*** may selectively turn on or off the switching transistor M_*i*, which corresponds to the Ith stage driving module **100_*i***, according to the comparison between the reference voltage $V_{RF}$ and the output voltage $V_{SUP}$, wherein i is smaller or equal to n, and is a positive integer.

The first reflecting module 102 outputs the triggering signal to the first input pin PIN_1 of the driving module 100_1 (or called the first stage driving module). Moreover, when the first reflecting module 102 receives the triggering signal fed back from the second output pin PIN_4 of the driving module 100_1 or the second output pin PIN_4 of the driving module 100_2 (or called the second stage driving module), the first reflecting module 102 may transfer this triggering signal to the first input pin PIN_1 of the driving module 100_1. The second reflecting module 104, via its first input pin PIN_1, receives the triggering signal sent from the first output pin PIN_2 of the driving module **100_*n* (or called the last stage driving module), and transfers the triggering signal to the second input pin PIN_3 of the driving module 100_*n*−1 (or called the second last stage driving module) through the output pin PIN_4 of the second reflecting module 104. In other words, the first reflecting module 102 and the second reflecting module 104 are configured to make sure that the voltage regulator 1** can operate normally during the transition period of the output voltage $V_{SUP}$.

Figure 3:
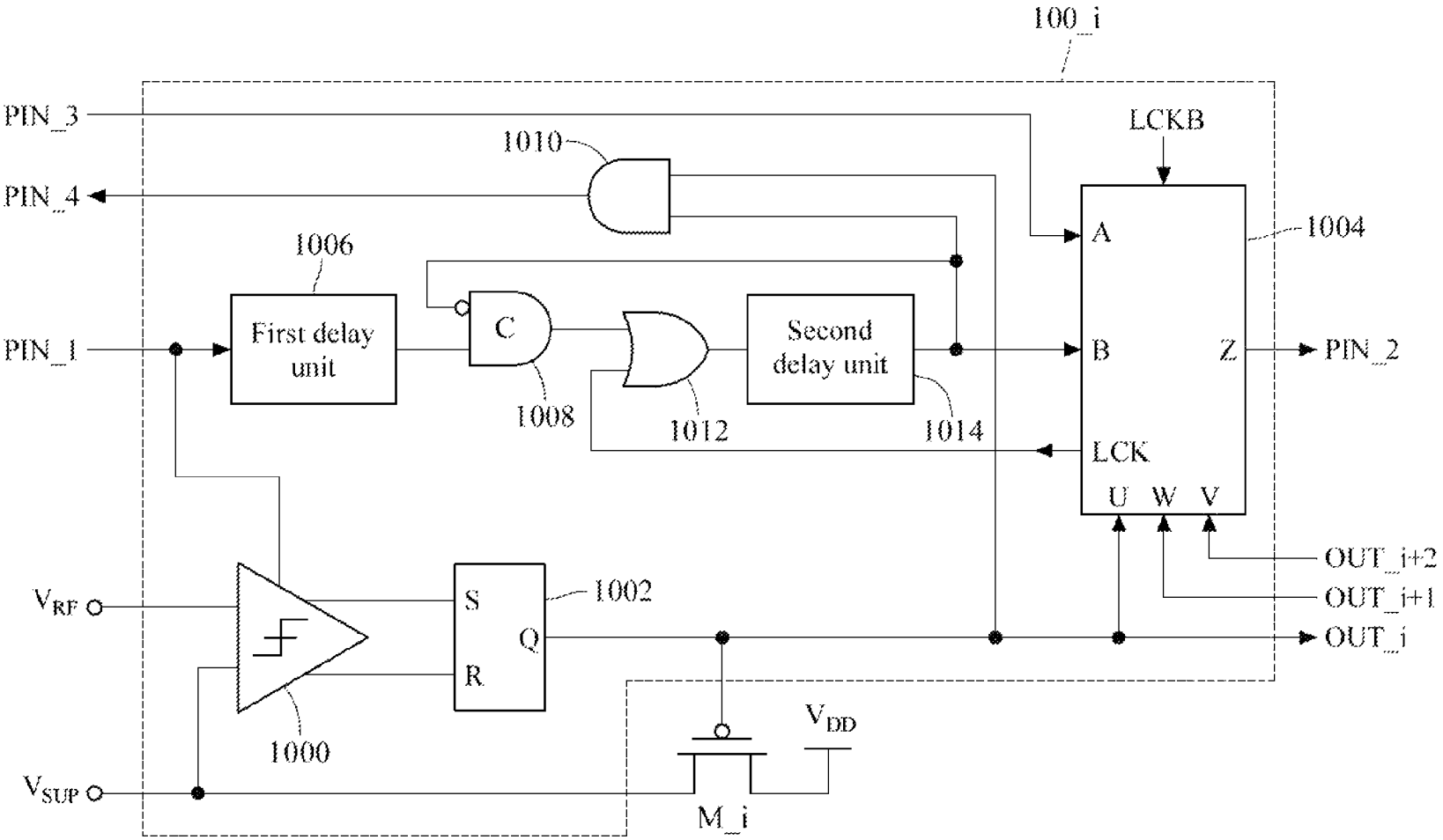
FIG. 3 is a circuit diagram of the Ith stage driving module in FIG. 2.

Referring to FIG. 3, the detail of the Ith stage driving module **100_*i* in FIG. 2 is illustrated. The Ith stage driving module 100_*i* comprises an amplifier 1000, a SR flip-flop 1002, a multiplexer 1004, a first delay unit 1006, a Muller C logic gate 1008, an AND logic gate 1010, an OR logic gate 1012, and a second delay unit 1014. One of the two input ends of the amplifier 1000 receives the reference voltage $V_{RF}$, and the other one of the two input ends of the amplifier 1000** receives the output voltage $V_{SUP}$ and is electrically connected to the second end of the switching transistor M_*i*. The two output ends of the amplifier 1000 are electrically connected to the S end and R end of the SR flip-flop 1002 respectively. The control end of the amplifier 1000 is electrically connected to the first input pin PIN_1 of the Ith stage driving module **100_*i***.

The output end (i.e. Q end) of the SR flip-flop 1002 is coupled to the output end OUT_*i* of the control circuit 10 and is electrically connected with the control end of the switching transistor M_*i*. The first delay unit 1006 is electrically connected with the first input pin PIN_1 of the Ith stage driving module **100_*i* and one of the input ends of the Muller C logic gate 1008. The other input end of the Muller C logic gate 1008 is electrically connected with the second delay unit 1014 and one of the input ends of the AND logic gate 1010. The output end of the Muller C logic gate 1008 is electrically connected with one of the input ends of the OR logic gate 1012. The other input end of the OR logic gate 1012 is electrically connected with the LCK end of the multiplexer 1004. The output end of the OR logic gate 1012 is electrically connected with one end of the second delay unit 1014. The other end of the second delay unit 1014 is electrically connected with one of the input ends of the AND logic gate 1010 and the B end of the multiplexer 1004**.

The other input end of the AND logic gate 1010 is electrically connected with the Q end of the SR flip-flop 1002. The output end of the AND logic gate 1010 is electrically connected with the second output pin PIN_4 of the Ith stage driving module 100_*i*. The second input pin PIN_3 of the Ith stage driving module 100_*i* is electrically connected with the A end of the multiplexer 1004. The Z end of the multiplexer 1004 is electrically connected with the first output pin PIN_2 of the Ith stage driving module 100_*i*. The U end, W end, and V end of the multiplexer 1004 are electrically connected with the output end OUT_i, the output end OUT_i+1, and the output end OUT_i+2 of the control circuit 10 respectively. Furthermore, the multiplexer 1004 receives a lock signal LCKB for controlling whether the switching transistor M_i is kept turned-on.

The amplifier 1000 is controlled by the triggering signal received by the first output pin PIN_1 of the Ith stage driving module 100_*i* to compare the reference voltage $V_{RF}$ with the output voltage $V_{SUP}$. For example, the amplifier 1000 is an error amplifier or a variable gain amplifier (VGA), but the disclosure is not limited thereto. The first delay unit 1006 and the second delay unit 1014 delay a first time period T1 and a second time period T2 respectively. The detail of the first time period T1 and the second time period T2 will be described in FIG. 4A and FIG. 4B later.

When the input ends of the Muller C logic gate 1008 receive a low logic signal of '0' at the same time, the output end of the Muller C logic gate 1008 outputs a low logic signal of '0'. When the input ends of the Muller C logic gate 1008 receive a high logic signal of '1' at the same time, the output end outputs a high logic signal of '1'. When the input ends of the Muller C logic gate 1008 receive a high logic signal of '1' and a low logic signal of '0' respectively at the same time, the output end of the Muller C logic gate 1008 does not change. The multiplexer 1004 may be a path multiplexer (PMUX), and its truth table is shown in Table 1.

TABLE 1

| UWV | Z |
|---|---|
| 1XX | 0 |
| 000 | B |
| 001 | A |
| 010 | B |
| 011 | B |

Figure 4A:
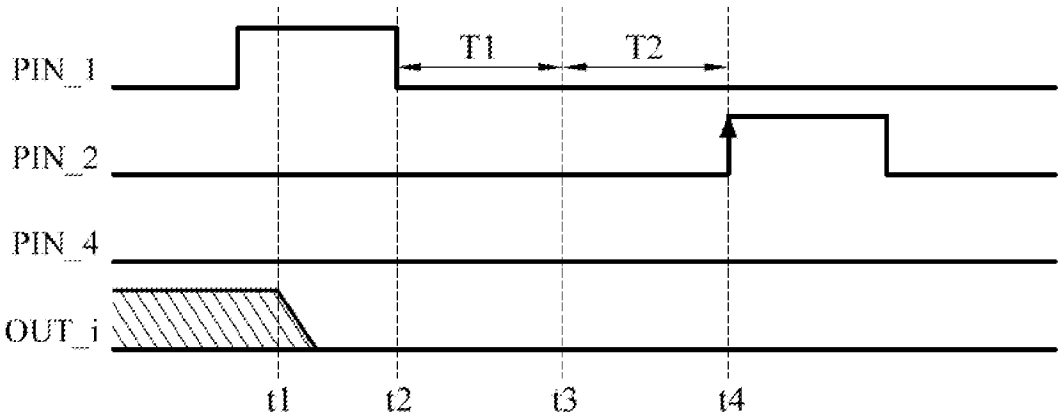
FIG. 4A is a sequence diagram of the Ith stage driving module in FIG. 2 when the output voltage is smaller than the reference voltage.
Figure 4B:
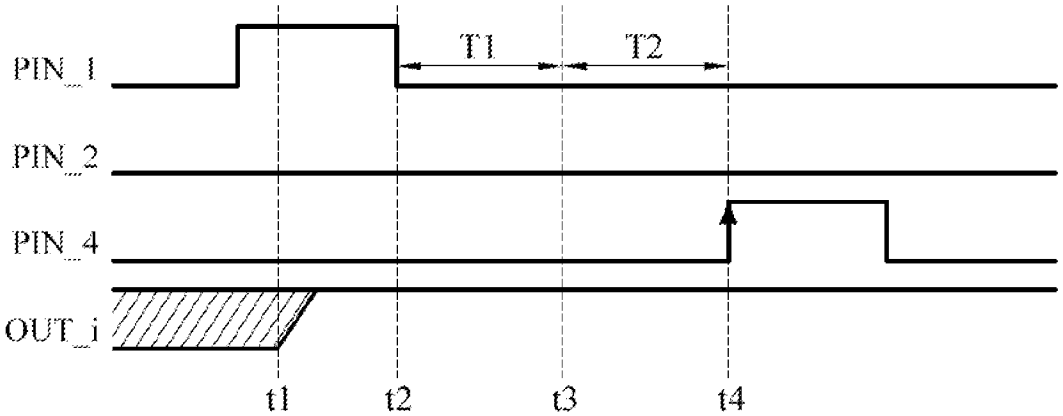
FIG. 4B is a sequence diagram of the Ith stage driving module in FIG. 2 when the output voltage is larger than the reference voltage.

Referring to FIG. 2, FIG. 3, FIG. 4A, and FIG. 4B, operation sequences of the Ith stage driving module 100_*i* are illustrated. FIG. 4A is a sequence diagram of the Ith stage driving module 100_*i* in FIG. 2 when the output voltage of the Ith stage driving module 100_*i* is smaller than the reference voltage, and FIG. 4B is a sequence diagram of the Ith stage driving module 100_*i* in FIG. 2 when the output voltage of the Ith stage driving module 100_*i* is larger than the reference voltage.

As shown in FIG. 4A, when the first input pin PIN_1 of the Ith stage driving module 100_*i* receives the triggering signal sent by the first output pin PIN_2 of the (I−1)th stage driving module 100_*i*−1, and when the amplifier 1000 in the Ith stage driving module 100_*i* determines that the output voltage $V_{SUP}$ is smaller than the reference voltage $V_{RF}$, the SR flip-flop 1002 controls the Q end to reduce the output voltage at time point t1. Therefore, the voltage of the output end OUT_i reduces, and the switching transistor M_i of the Ith stage driving module 100_*i* is then turned on. After the first time period T1 and the second time period T2, the Z end of the multiplexer 1004 outputs the triggering signal to the first output pin PIN_2 of the Ith driving module 100_*i*. In other words, when the Ith stage driving module 100_*i* determines that the output voltage $V_{SUP}$ is smaller than the reference voltage $V_{RF}$, the Ith stage driving module 100_*i* turns on the switching transistor M_i, which corresponds to the Ith stage driving module 100_*i*, to increase the output voltage $V_{SUP}$, and sends the triggering signal to the (I+1)th stage driving module 100_*i*+1 after a preset period.

As shown in FIG. 4B, when the first input pin PIN_1 of the Ith stage driving module 100_*i* receives the triggering signal sent by the first output pin PIN_2 of the (I−1)th stage driving module 100_*i*−1, and when the amplifier 1000 in the Ith stage driving module 100_*i* determines that the output voltage $V_{SUP}$ is larger than the reference voltage $V_{RF}$, the SR flip-flop 1002 increases the voltage outputted by the Q end at time point t1, so that the voltage of the output end OUT_i increases. The switching transistor M_i corresponding to the Ith stage driving module 100_*i* is then turned off. After the first time period T1 and the second time period T2, the second output pin PIN_4 of the driving module 100_*i* outputs the triggering signal.

In other words, when the Ith stage driving module 100_*i* determines that the output voltage $V_{SUP}$ is larger than the reference voltage $V_{RF}$, the Ith stage driving module 100_*i* feeds the triggering signal back to the second input pin PIN_3 of the (I−2)th stage driving module 100_*i*−2, and the (I−2)th stage driving module 100_*i*−2 transfers the triggering signal to the (I−1)th stage driving module 100_*i*−1. Therefore, the (I−1)th stage driving module 100_*i*−1 turns off the switching transistor M_i−1, which corresponds to the (I−1)th stage driving module 100_*i*−1, according to the comparison between the reference voltage $V_{RF}$ and the output voltage $V_{SUP}$ in order to reduce the output voltage $V_{SUP}$.

Furthermore, after the (I−1)th stage driving module 100_*i*−1 turns off the switching transistor M_i−1 corresponding to the (I−1)th stage driving module 100_*i*−1, the (I−1)th stage driving module 100_*i*−1 feeds the received triggering signal back to the (I−3)th stage driving module 100_*i*−3, and then the (I−3)th stage driving module 100_*i*−3 transfers the triggering signal to the (I−2)th stage driving module 100_*i*−2.

Figure 5:
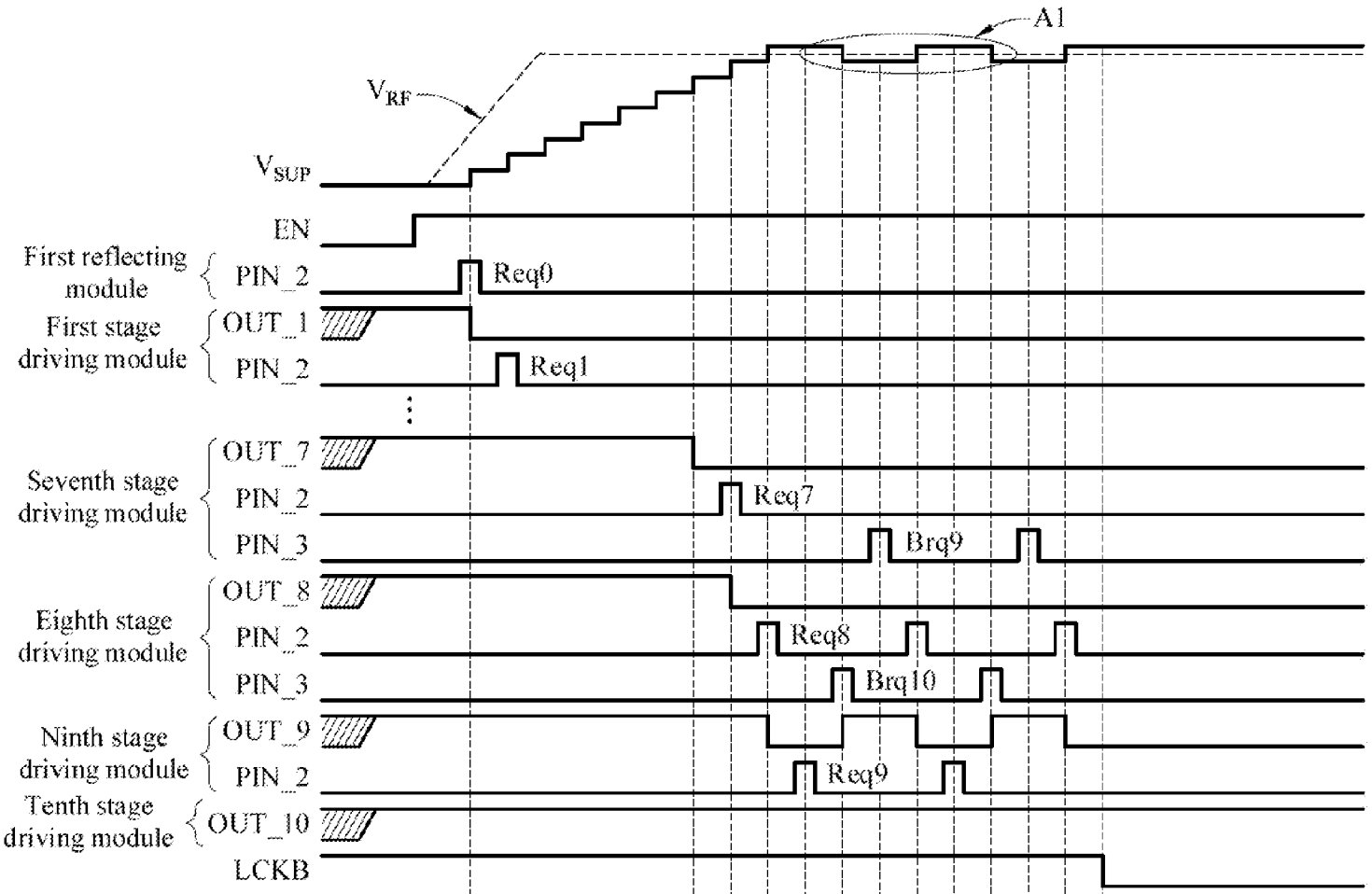
FIG. 5 is a sequence diagram of the control circuit in FIG. 2.

To more clearly illustrate the operation of the driving modules 100_1 to 100_*n* in FIG. 2, a sequence diagram of the control circuit in FIG. 2 is shown in FIG. 5. In one embodiment, the number of the driving modules 100_1 to 100_*n* is at least ten, so n is larger than or equal to ten.

As shown in FIG. 5, when the first input pin PIN_1 of the first reflecting module 102 has not received the enabling signal EN yet, the output ends OUT_1 to OUT_n of the driving modules 100_1 to 100_*n* are in high voltage level, so the switching transistors M_1 to M_n are turned off and the output voltage $V_{SUP}$ is zero. When the first input pin PIN_1 of the first reflecting module 102 receives the enabling signal EN, the first output pin PIN_2 of the first reflecting module 102 provides a triggering signal Req0 to the first stage driving module 100_1. According to the triggering signal Req0, the first stage driving module 100_1 knows that the output voltage $V_{SUP}$ is smaller than the reference voltage $V_{RF}$, and then reduces the voltage level of the output end OUT_1 at the time point t1. Therefore, the switching transistor M_1 is turned on, and provides a triggering signal Req1 to the first input pin PIN_1 of the second stage driving module 100_2 through the first output pin PIN_2 of the first stage driving module 100_1. The operation of the second stage driving modules 100_2 to the seventh stage driving module 100_7 can be deduced by analogy.

When the first output pin PIN_2 of the eighth stage driving module 100_8 provides a triggering signal Req8 to the first input pin PIN_1 of the ninth stage driving module 100_9, the ninth stage driving module 100_9 will know that the output voltage $V_{SUP}$ during the time period between the time points t3 and t4 is still smaller than the reference voltage $V_{RF}$, and then reduces the voltage level of the output end OUT_9 at the time point t4. Therefore, the switching transistor M_9 is turned on, the output voltage $V_{SUP}$ increases, and the ninth stage driving module 100_9 provides a triggering signal Req9 to the tenth stage driving module 100_10.

When the first input pin PIN_1 of the tenth stage driving module 100_10 receives the triggering signal Req9, the tenth stage driving module 100_10 will know that the output voltage $V_{SUP}$ is larger than the reference voltage $V_{RF}$ during the time period between the time points t4 and t5. Therefore, the tenth stage driving module 100_10 does not change the voltage level of the output end OUT 10 so that the output voltage $V_{SUP}$ is remained. Moreover, the tenth stage driving module 100_10, through the second output pin PIN_4, feeds a triggering signal Brq10 back to the second input pin PIN_3 of the eighth stage driving module 100_8, so that the eighth stage driving module 100_8 transfers the triggering signal Brq10 to the ninth stage driving module 100_9.

When the first input pin PIN_1 of the ninth stage driving module 100_9 receives the triggering signal Brq10 sent by the tenth stage driving module 100_10, the ninth stage driving module 100_9 will know that the output voltage $V_{SUP}$ is larger than the reference voltage $V_{RF}$ during the time period between the time points t5 and t6. Therefore, the ninth stage driving module 100_9 increases the voltage level of the output end OUT_9 at the time point t6 to turn off the switching transistor M_9 to decrease the output voltage $V_{SUP}$. The ninth stage driving module 100_9, through the second output pin PIN_4, sends the triggering signal Brq9 back to the second input pin PIN_3 of the seventh driving module 100_7, so that the seventh driving module 100_7 further transfers the triggering signal Brq9 to the eighth stage driving module 100_8.

When the first input pin PIN_1 of the eighth stage driving module 100_8 receives the triggering signal Brq9 sent by the ninth stage driving module 100_9, since the switching transistor M_8, which corresponds to the eighth stage driving module 100_8, has been turned on, the eighth stage driving module may directly provide the triggering signal Req8 to the ninth stage driving module 100_9.

When the ninth stage driving module 100_9 receives the triggering signal Req9, the ninth stage driving module 100_9 will know that the output voltage $V_{SUP}$ is smaller than the reference voltage $V_{RF}$ during the time period between the time points t7 and t8. Also, the ninth stage driving module 100_9 decreases the voltage level of the output end OUT_9 at the time point t8 to turn on the switching transistor M_9 to increase the output voltage $V_{SUP}$. The ninth stage driving module 100_9 then provides the triggering signal Req9 to the tenth stage driving module 100_10.

In this way, since the switching transistor M_9 is continually and alternately turned on and off, the output voltage $V_{SUP}$ of the voltage regulator 1 oscillates based on the reference voltage $V_{RF}$, as shown in the voltage oscillation area A1 in FIG. 5.

Furthermore, when the output voltage $V_{SUP}$ approaches the reference voltage $V_{RF}$ and one of the switching transistors M_1 to M_n is repeatedly switched between on and off, the voltage regulator 1 keeps the switching transistor on to stabilize the output voltage $V_{SUP}$ so that the energy spent for repeatedly switching the switching transistor between on and off is saved. For example, in FIG. 5, when the voltage regulator 1 determines that the switching transistor M_9 is repeatedly switched between on and off, the voltage regulator 1 disables the lock signal LCKB at the time point t13 to keep the switching transistor M_9 on to stabilize the output voltage $V_{SUP}$ which Herein, the output voltage $V_{SUP}$ is slightly larger than the reference voltage $V_{SUP}$. Moreover, when the switching transistor M_9 keeps on, the ninth driving module 100_9, which corresponds to the switching transistor M_9, stops transferring the triggering signal.

In the disclosure, there is no limitation on the increase range of the output voltage $V_{SUP}$ when each of the switching transistors M_1 to M_n is turned on. The driving current provided by the Ith driving module **100_*i* is not related to the driving current provided by the driving module 100_*i*−1 and the driving current provided by the driving module 100_*i*+1**.

Thereinafter, according to one or more embodiments, the disclosure also provides a control method of the voltage regulator 1 in FIG. 1. The control method is adapted to dynamically adjust the output voltage $V_{SUP}$ outputted by the voltage regulator 1.

Figure 6:
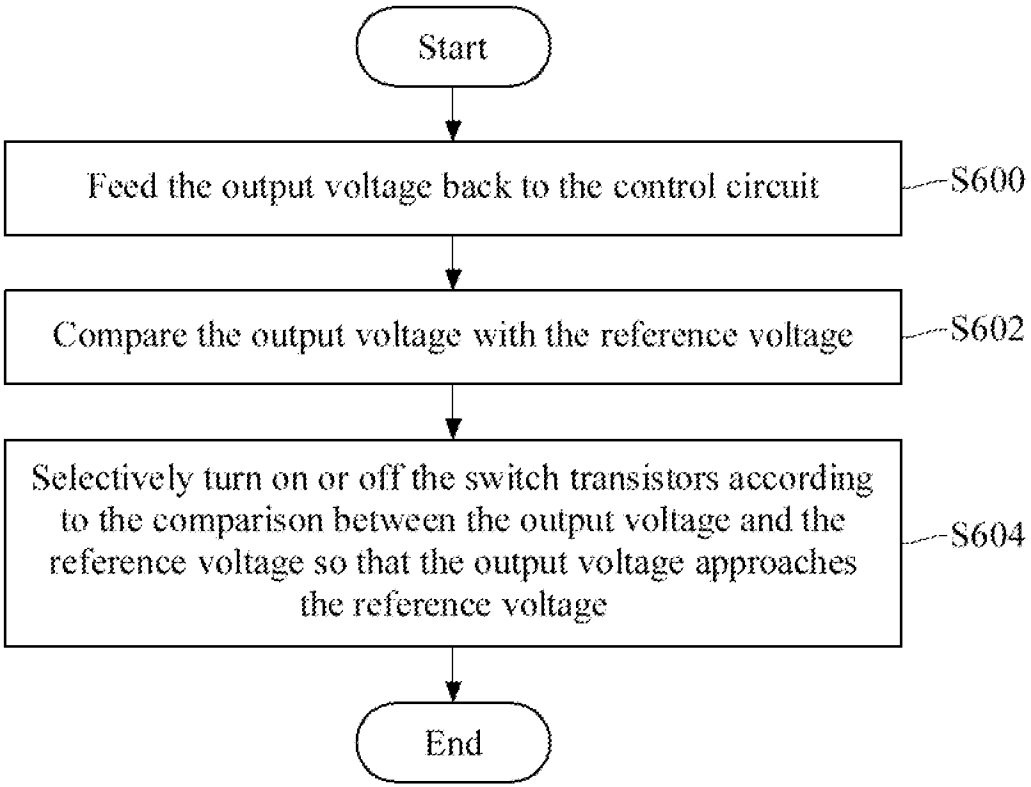
FIG. 6 is a flow chart of a control method of the voltage regulator in an embodiment in the disclosure.

Referring to FIG. 1 and FIG. 6, a flow chart of the control method of the voltage regulator 1 in one embodiment is illustrated. The voltage regulator 1 comprises a plurality of switching transistors M_1 to M_n and a control circuit 10. Each of the switching transistors M_1 to M_n comprises a first end, a second end, and a control end. The first ends of the switching transistors M_1 to M_n receive the driving voltage $V_{DD}$. The second ends of the switching transistors M_1 to M_n are electrically connected with the nodes which supply the output voltage $V_{SUP}$. The control ends of the switching transistors M_1 to M_n are electrically connected with the control circuit 10, so the switching transistors M_1 to M_n are controlled by the control circuit 10.

In step S600, the voltage regulator 1 feeds the output voltage $V_{SUP}$ back to the control circuit 10. Moreover, the voltage regulator 1 provides the reference voltage $V_{RF}$ to the control circuit 10. In step S602, the control circuit 10 compares the output voltage $V_{SUP}$ with the reference voltage $V_{RF}$. Lastly, in step S604, the control circuit 10 selectively turns the switch transistors M_1 to M_n on or off according to the comparison between the output voltage $V_{SUP}$ and the reference voltage $V_{RF}$ so that the output voltage $V_{SUP}$ approaches the reference voltage $V_{RF}$.

In the step S602, when the output voltage $V_{SUP}$ is smaller than the reference voltage $V_{RF}$, the control circuit 10 turns on one or more of the switching transistors M_1 to M_n until the output voltage $V_{SUP}$ is larger than the reference voltage $V_{RF}$. In contrast, when the output voltage $V_{SUP}$ is larger than the reference voltage $V_{RF}$, the control circuit 10 turns off one or more of the switching transistors M_1 to M_n until the output voltage $V_{SUP}$ is smaller than the reference voltage $V_{RF}$.

When the output voltage $V_{SUP}$ approaches the reference voltage $V_{RF}$ and one of the switching transistors M_1 to M_n is repeatedly switched between on and off, the control circuit 10 keeps the one of the switching transistors M_1 to M_n on to stabilize the output voltage $V_{SUP}$.

Figure 7:
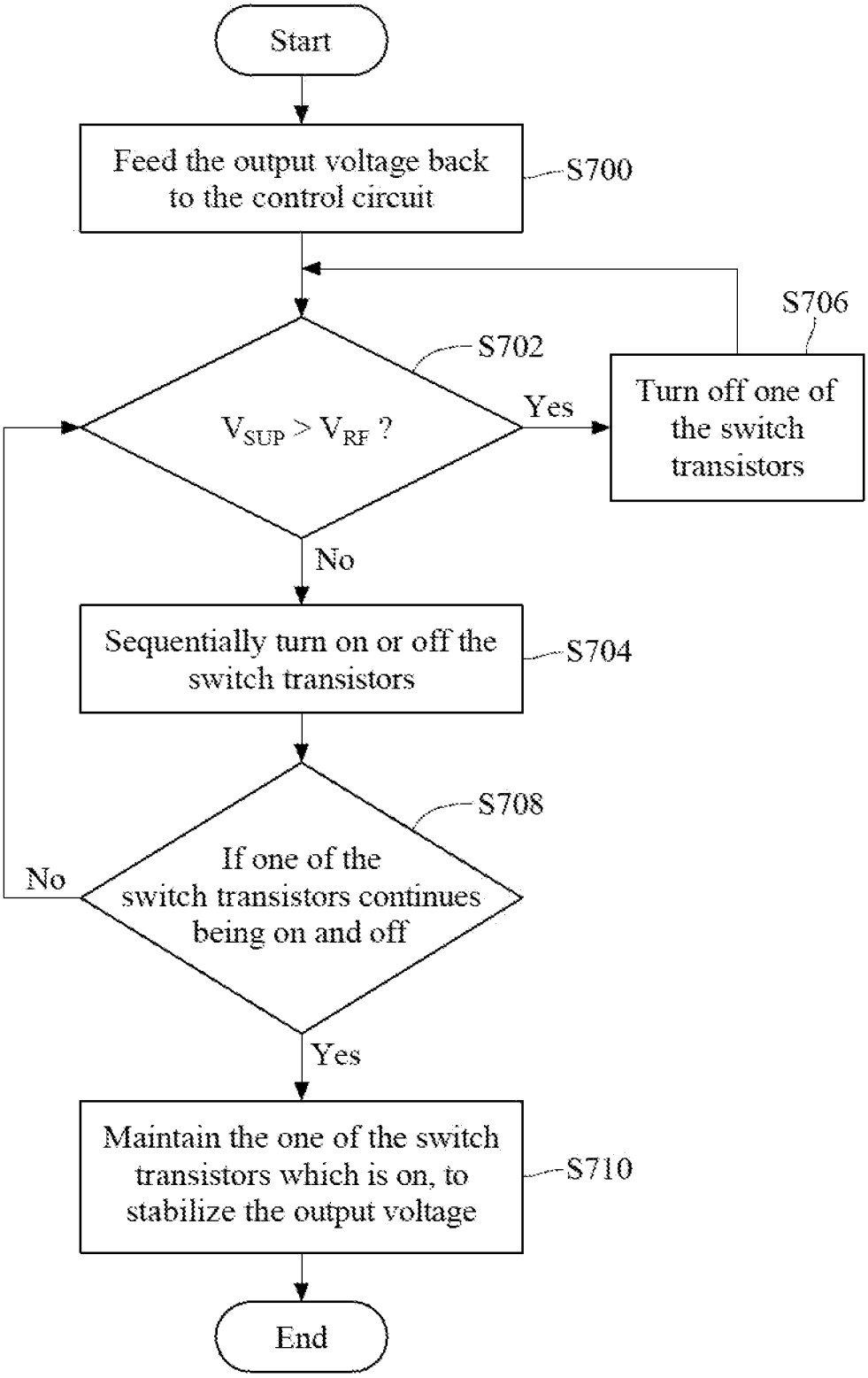
FIG. 7 is a flow chart of a control method of the voltage regulator in another embodiment in the disclosure.

Referring to FIG. 1 and FIG. 7, a flow chart of the control method of the voltage regulator 1 in other embodiment is illustrated. In step S700, the voltage regulator 1 feeds the output voltage $V_{SUP}$ back to the control circuit 10. In step S702, the control circuit 10 determines whether the output voltage $V_{SUP}$ is larger than the reference voltage $V_{RF}$. When the control circuit 10 determines that the output voltage $V_{SUP}$ is smaller than the reference voltage $V_{RF}$, as shown in step S704, the control circuit 10 sequentially turns on the switching transistors M_1 to M_n to increase the output voltage $V_{SUP}$. When the control circuit 10 determines that the output voltage $V_{SUP}$ is larger than the reference voltage $V_{RF}$, the control circuit 10 sequentially turns off the switching transistors M_1 to M_n to decrease the output voltage $V_{SUP}$ as shown in step S706, and the control method returns to the step S702.

Follow the step S704, in step S708, the control circuit 10 determines whether one of the switching transistors M_1 to M_n is repeatedly switched between on and off. If the control circuit 10 determines that one of the switching transistors M_1 to M_n has been repeatedly switched between on and off over a preset number of times, the control circuit 10 keeps this switching transistor on to stabilize the output voltage $V_{SUP}$ as shown in step S710. If the control circuit 10 determines that one of the switching transistors M_1 to M_n has not been repeatedly switched between on and off over the preset number of times, the control method returns to the step S702.

In view of the embodiments of the voltage regulator and the control method thereof, through monitoring the change of the output voltage, the control circuit may dynamically adjust the number of the switching transistors which are turned on to make the output voltage of the voltage regulator approach the reference voltage. Moreover, since the driving modules correspond to the switching transistors in the control circuit, the driving modules may operate through certain driving events so that the voltage regulator does not require a fixed clock signal to operate normally. Thus, there is only one driving module operating at a time point, and the static work current of the other driving modules is close to zero. This may not only reduce the waste of current in the control circuit but also prevent the occurrence of the inrush current.

What is claimed is:

1. A voltage regulator, adapted to dynamically adjust an output voltage from a first output end of the voltage regulator, and comprising:

a plurality of switching transistors, wherein each of the plurality of switching transistor has a first end, a second end, and a control end, the first ends receive a driving voltage, the second ends are electrically connected with the first output end, and the switching transistor is configured to adjust the output voltage; and a control circuit, comprising an input end, a feedback end, a plurality of second output ends and a plurality of driving modules;

wherein the input end receives a reference voltage, the feedback end receives the output voltage, the second output ends are electrically connected with the control ends of the switching transistors respectively, the plurality of driving modules are electrically connected with each other, each of the plurality of driving modules receives the reference voltage and the output voltage and electrically connects with one of the plurality of switching transistors, and the control circuit is configured to compare the output voltage with the reference voltage, and selectively turn on or off the plurality of switching transistors according to the comparison between the output voltage and the reference voltage so that the output voltage approaches the reference voltage;

wherein when the output voltage approaches the reference voltage and one of the plurality of switching transistors is repeatedly switched between on and off, the voltage regulator keeps the switching transistor, which is repeatedly switched between on and off, turned on, to stabilize the output voltage; and wherein an Ith stage driving module in the plurality of driving modules selectively turns on or off the switching transistors corresponding to the Ith stage driving module according to the comparison between the reference voltage and the output voltage when receiving a triggering signal, and I is a positive integer.

2. The voltage regulator according to claim 1, wherein when the output voltage is smaller than the reference voltage, the control circuit turns on one or more of the plurality of switching transistors, and when the output voltage is larger than the reference voltage, the control circuit turns off one turned-on switching transistor.

3. The voltage regulator according to claim 1, wherein when the output voltage is larger than the reference voltage, the control circuit turns off one or more of the plurality of switching transistors, and when the output voltage is smaller than the reference voltage, the control circuit turns on one turned-off switching transistor.

4. The voltage regulator according to claim 1, wherein when the output voltage is smaller than the reference voltage, the Ith stage driving module turns on the switching transistor corresponding to the Ith stage driving module and sends the triggering signal to a (I+1)th stage driving module in the plurality of driving modules.

5. The voltage regulator according to claim 1, wherein when the output voltage is larger than the reference voltage, the Ith stage driving module feeds the triggering signal back to a (I−2)th stage driving module in the plurality of driving modules, and the (I−2)th stage driving module then transfers the fed-back triggering signal to a (I−1)th stage driving module in the plurality of driving modules, so that the (I−1)th stage driving module turns off the switching transistor corresponding to the (I−1)th stage driving module according to the comparison between the reference voltage and the output voltage.

6. The voltage regulator according to claim 5, wherein after the (I−1)th stage driving module turns off the switching transistor corresponding to the (I−1)th stage driving module, the (I−1)th stage driving module feeds the triggering signal back to a (I−3)th stage driving module in the plurality of driving modules, and then the (I−3)th stage driving module transfers the triggering signal to the (I−2)th stage driving module.

7. The voltage regulator according to claim 1, wherein the control circuit further comprises:

a first reflecting module, configured to provide the triggering signal to a first stage driving module in the plurality of driving modules and to transfer the triggering signal outputted by the first stage driving module or a second stage driving module in the plurality of driving modules to the first stage driving module; and a second reflecting module, configured to transfer the triggering signal sent by a last stage driving module in the plurality of driving modules to a second last stage driving module in the plurality of driving modules, so that the second last stage driving module transfers the transferred triggering signal to the last stage driving module.

8. A control method of a voltage regulator, comprising:

feeding an output voltage back to a control circuit;

comparing the output voltage with a reference voltage; and selectively turning on or off a plurality of switch transistors according to the comparison between the output voltage and the reference voltage so that the output voltage approaches the reference voltage;

wherein when the output voltage approaches the reference voltage and one of the plurality of switching transistors is repeatedly switched between on and off, the voltage regulator keeps the switching transistor, which is repeatedly switched between on and off, turned on, to stabilize the output voltage; and wherein the control circuit comprises a plurality of driving modules, the plurality of driving modules are electrically connected with each other, each of the plurality of driving modules receives the reference voltage and the output voltage and electrically connects with one of the plurality of switching transistors, and when an Ith stage driving module of the plurality of driving modules receives a triggering signal, the Ith stage driving module selectively turns on or off the switching transistor corresponding to the Ith stage driving module according to the comparison between the reference voltage and the output voltage, and I is a positive integer.

9. The control method according to claim 8, wherein when the output voltage is smaller than the reference voltage, the control circuit turns on one or more of the plurality of switching transistors, and when the output voltage is larger than the reference voltage, the control circuit turns off one turned-on switching transistor.

10. The control method according to claim 8, wherein when the output voltage is larger than the reference voltage, the control circuit turns off one or more of the plurality of switching transistors, and when the output voltage is smaller than the reference voltage, the control circuit turns on one turned-off switching transistor.

11. The control method according to claim 8, wherein when the output voltage is smaller than the reference voltage, the Ith stage driving module turns on the switching transistor corresponding to the Ith stage driving module and sends the triggering signal to a (I+1)th stage driving module in the plurality of driving modules.

12. The control method according to claim 8, wherein when the output voltage is larger than the reference voltage, the Ith stage driving module feeds the triggering signal back to a (I−2)th stage driving module in the plurality of driving modules, and the (I−2)th stage driving module then transfers the fed-back triggering signal to a (I−1)th stage driving module in the plurality of driving modules, so that the (I−1)th stage driving module turns off the switching transistor corresponding to the (I−1)th stage driving module according to the comparison between the reference voltage and the output voltage.

13. The control method according to claim 12, wherein after the (I−1)th stage driving module turns off the switching transistor corresponding to the (I−1)th stage driving module, the (I−1)th stage driving module feeds the triggering signal back to a (I−3)th stage driving module in the plurality of driving modules, and then the (I−3)th stage driving module transfers the triggering signal to the (I−2)th stage driving module.

14. The control method according to claim 8, wherein the control circuit further comprises:

a first reflecting module, configured to provide the triggering signal to a first stage driving module in the plurality of driving modules, and configured to transfer the triggering signal outputted by the first stage driving module or a second stage driving module in the plurality of driving modules to the first stage driving module; and a second reflecting module, configured to transfer the triggering signal sent by a last stage driving module in the plurality of driving modules to a second last stage driving module in the plurality of driving modules, so that the second last stage driving module transfers the transferred triggering signal to the last stage driving module.

15. A voltage regulator, adapted to dynamically adjust an output voltage from a first output end of the voltage regulator, and comprising:

a plurality of switching transistors, wherein each of the plurality of switching transistor has a first end, a second end, and a control end, the first ends receive a driving voltage, the second ends are electrically connected with the first output end, and the switching transistor is configured to adjust the output voltage; and a control circuit, comprising an input end, a feedback end, and a plurality of second output ends, wherein the input end receives a reference voltage, the feedback end receives the output voltage, the second output ends are electrically connected with the control ends of the switching transistors respectively, and the control circuit is configured to compare the output voltage with the reference voltage, and selectively turn on or off the plurality of switching transistors according to the comparison between the output voltage and the reference voltage so that the output voltage approaches the reference voltage, wherein the control circuit further comprises a plurality of driving modules, the plurality of driving modules are electrically connected with each other, and each driving module receives the reference voltage and the output voltage and electrically connects with one of the plurality of switching transistors; and when an Ith stage driving module in the plurality of driving modules receives a triggering signal, the Ith stage driving module selectively turns on or off the plurality of switching transistors corresponding to the Ith stage driving module according to the comparison between the reference voltage and the output voltage, and I is a positive integer.

* * * * *